US006951178B2

(12) United States Patent
Watts

(10) Patent No.: US 6,951,178 B2
(45) Date of Patent: Oct. 4, 2005

(54) QUILTING MACHINE

(76) Inventor: J Watts, 7 Tarpan Ct. Yamaito 4305, Ipswich (AU)

( * ) Notice: Subject to any disclaimer, the term of this patent is extended or adjusted under 35 U.S.C. 154(b) by 368 days.

(21) Appl. No.: 10/616,595

(22) Filed: Jul. 11, 2003

(65) Prior Publication Data

US 2004/0255835 A1 Dec. 23, 2004

(51) Int. Cl.[7] ..... D05B 11/00
(52) U.S. Cl. ..... 112/118; 112/221
(58) Field of Search ..... 112/102, 117, 112/118, 119, 220, 221, 304, 305, 307, 318; 188/68, 73.1, 82.8, 85, 166; 192/12 B, 12 R; 38/102.21

(56) References Cited

U.S. PATENT DOCUMENTS 1,092,348 A * 4/1914 Friedlund ..... 38/102.21
2,684,651 A * 7/1954 Lajos ..... 112/308
3,190,247 A * 6/1965 Schifano et al. ..... 112/470.12
4,192,241 A * 3/1980 Reed et al. ..... 112/117
4,423,692 A * 1/1984 Kelly et al. ..... 112/274
6,631,688 B1 * 10/2003 Maag ..... 112/118

* cited by examiner

*Primary Examiner*—Ismael Izaguirre
(74) *Attorney, Agent, or Firm*—Angenehm Law Firm, LTD; N Paul Friederichs

(57) ABSTRACT

A quilting machine including: a frame to support at least one pair of elongated roller members, the roller members are spaced apart and freely rotating and adapted to support quilting fabric material disposed therebetween and wound around the roller members, the rotation of the roller members enabling the material to be rolled towards and away from the sewing arm of a sewing machine, sliding track means adapted to support the sewing machine, the track members slidable in a directional plane parallel to and perpendicular to the roller members, quick release braking means adapted to brake the rotation of the roller members, wherein in use, in co-operation with the sliding track means, and by applying and releasing the braking means, the direction of rotation of the roller members can be controlled and material can be rapidly rolled towards or away from the sewing machine to enable continuous stitching of indefinite length to be sewn in either direction perpendicular to the roller members irrespective of the depth the sewing machine arm as well as in a direction parallel to the roller members without doubling back or braking the stitch line.

10 Claims, 5 Drawing Sheets

QUILTING MACHINE

FIELD OF INVENTION

This invention relates to sewing apparatus in particular but not exclusively to an improved quilting machine which allows for infinitely variable fabric tensioning and unbroken stitching of indefinite length in a direction towards and away from a sewing machine irrespective of the depth of the sewing machine arm.

BACKGROUND ART

Prior art sewing and quilting machines are well known. They invariably involve the use of electrical sewing machines mounted or supported on a frame or other arrangement to enable the stitching of large areas of fabric typically quilting material. The principle disadvantage or limitation of the prior art is that the length of the stitch line is usually restricted by the depth of the arm of the particular sewing machine. Although there have been some arrangements that allow for the scrolling or rolling of the quilt material as the stitching reaches the maximum length of the sewing machine arm, there has been no facility to provide easy positioning of the material so that a continuous stitch line can sewn in both a forward and a reverse direction with respect to the sewing machine. In addition, prior art quilting machines do not easily transfer fabric between feed and take up rollers while accurately setting fabric tension. Prior art arrangements which include ratchet and friction systems are cumbersome and often result in a broken stitch line or a doubling back of the stitching when a continuous line of stitching is required. Ratchet systems have limited accuracy with fabric tensioning and with friction systems, fabric transfer is difficult. Both these factors detract from the eveness and uniformity of the stitching. This is particularly important in the art of quilting where it detracts from the overall quality of the finished quilt work as the stitch work is a crucial factor. Quality of quilt work is invariably judged or measured on a close inspection of the stitch work. There is therefore a need for an improved quilting machine which enables infinitely variable fabric tensioning and unbroken and even lines of continuous stitching. In addition there is also a need for easy transfer of fabric in both a forward and a reverse direction with respect to the position of the sewing machine notwithstanding the limited depth of the arm of the sewing machine.

OBJECT OF THE INVENTION

It is therefore an object of the present invention to seek to ameliorate the disadvantages of the prior art by providing an improved quilting machine or to at least provide the public with a useful choice.

STATEMENT OF THE INVENTION

In one aspect, the invention resides in a quilting machine including:

- a frame to support at least one pair of elongated roller members,
- the roller members are spaced apart and freely rotating and adapted to support quilting fabric material disposed therebetween and wound around the roller members,
- the rotation of the roller members enabling the material to be rolled towards and away from the sewing arm of a sewing machine,
- sliding track means adapted to support the sewing machine, the track members slidable in a directional plane parallel to and perpendicular to the roller members,

- quick release braking means adapted to simultaneously brake the rotation of the roller members, wherein in use,
- in co-operation with the sliding track means, and by applying and releasing the braking means, the direction of rotation of the roller members can be controlled and material can be rapidly rolled in the direction towards or away from the sewing machine to enable continuous stitching of indefinite length to be sewn in either direction perpendicular to the roller members irrespective of the depth the sewing machine arm in either direction as well as in a direction parallel to the roller members without doubling back or braking the stitch line.

Preferably the quilting machine is demountable so as to be portable and the components including the roller members, braking means, and the sliding track means are made of a lightweight material such as aluminum or an equivalent lightweight material of suitable strength.

In the alternative, the brakes are not operated simultaneously, but individually for individual application and release of the braking means on each disc member.

Preferably the quick release brake means comprises disc members at the end of each of the roller members, said disc members braked by a spring loaded lever pivot action brake which applies braking pressure via brake shoes or pads to each disc member simultaneously.

In a further example, the braking means can comprise a hydraulically operated braking system or a cable braking system to apply pressure to the disc members via brake shoes or pads which engage the disc members. In a preferred example, the disc members can be "V" pulleys and the brake shoes can be V-shaped adapted to engage the grooves of the "V" pulleys.

Preferably the disc members when braked can still be rotated in at least one direction to enable the fabric material to be accurately tensioned with respect to the roller members.

Preferably the disc members of the braking means have winding handles for the quick rotation of the roller members.

Preferably the sliding track means includes a platform to support a domestic sewing machine having a nylon or other equivalent runners and/or wheels for smooth operation to enable the sewing machine to be drawn by a user across the roller members and along the length of the roller members.

Preferably the sliding track means includes trigger means adapted to operate the sewing machine which is easily accessible to the user.

Preferably, the brake shoes or pads are operated simultaneously by being interconnected via cables or by slotted link members.

BRIEF DESCRIPTION OF THE DRAWINGS

In order that the invention be better understood and put into practical effect, reference will now be made to the accompanying drawings wherein.

DETAILED DESCRIPTION OF DRAWINGS

Figure 1:
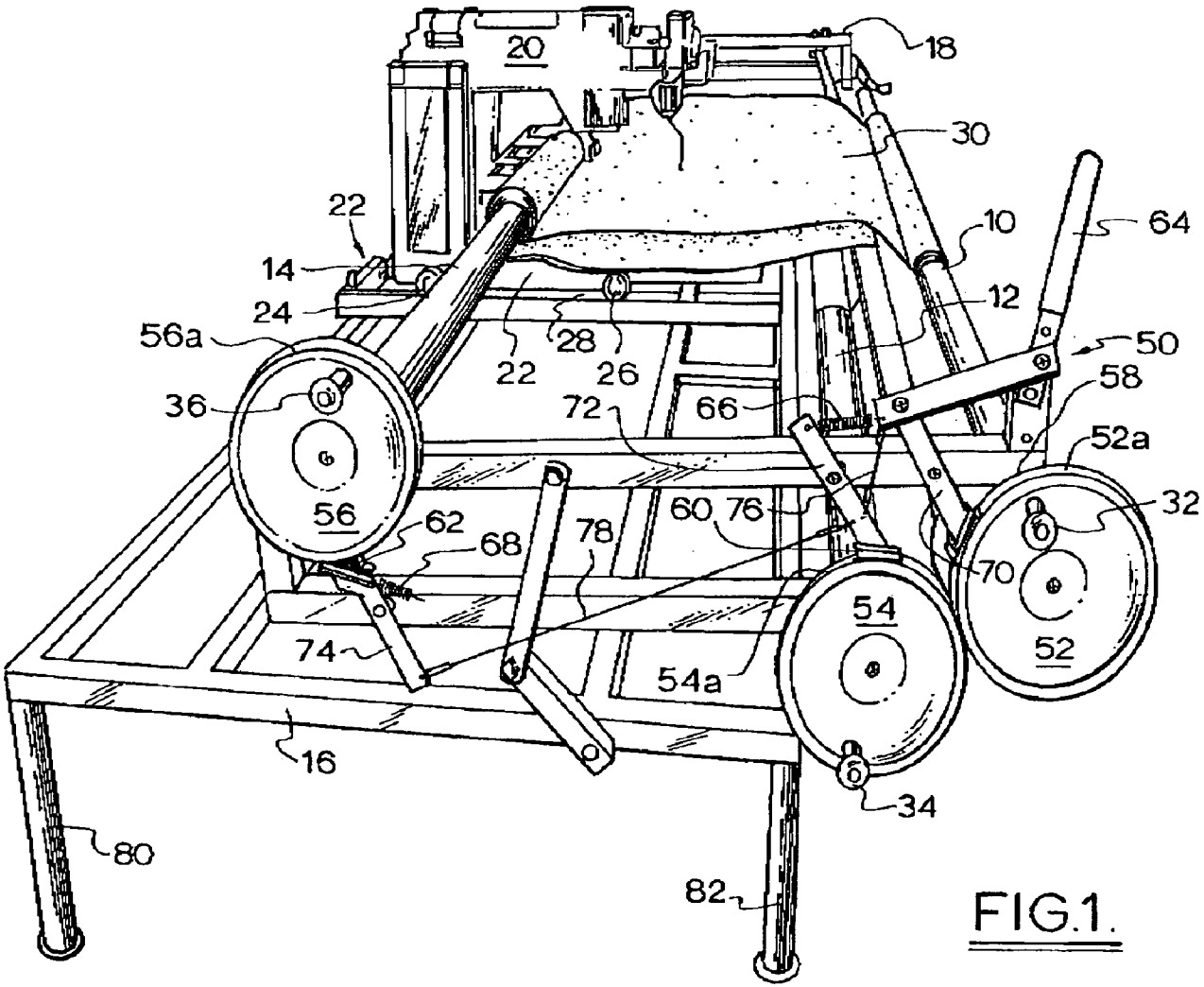
FIG. 1 shows a perspective view of a preferred embodiment of the invention.

Referring to FIG. 1 there is shown a preferred quilting machine according to the invention. The roller members 10, 22, 14 are preferably aluminum tubing sections which are supported longitudinally in a box sectioned aluminum frame assembly 16, 18. The sewing machine 20 which can be a domestic model is mounted on a sliding platform 22 with wheels 24, 26 running in tracks 28 and is positioned perpendicularly to the roller members such that the sewing machine can move on the sliding track means in both a direction perpendicular to the roller members and parallel to the roller members. Quilting fabric 30 is supported by being wound around the roller members and can be advanced towards or rolled away from the sewing machine by winding the handles 32, 34, 36 on the disc members 52, 54, 56 which are preferably V pulleys connected to the ends of the roller members. Preferably in this example, pulleys 52, 54, are attached to feed rollers 10, 12 whereas pulley 56 is attached to take up roller 14. FIG. 1 shows the braking means 50 in the braked position, however, the V pulleys 52, 54, 56 can still be turned against the resistance of the brakes 58, 60, 62 in at least one direction in order to adjust or correct the tension of the fabric material. The sliding track means supporting the sewing machine is moved in a direction parallel to the roller members for stitching along that direction and by continuously rolling the fabric on the roller members towards or away from the sewing machine, stitching of indefinite length perpendicular to the roller members can be enabled by quickly releasing and reapplying of the braking means. The braking means comprises a lever operated pivot action brake assisted by springs 66, 68 which apply a load to pivot members 70, 72, 74 carrying the brake shoes which engage the grooves 52*a*, 54*a*, 56*a* of the V pulleys. The pivot members are preferably connected by cables 76, 78 or in the alternative by slotted linkatures so that the lever 64 can be used to simultaneously apply or release the brakes on all the pulleys. In an alternative arrangement, the brakes can be made to operate individually and non-simultaneously on each pulley member. The quilting machine is preferably demountable for easy packaging and transporting purposes and is supported on its own leg members 80, 82, however, it can be bench mounted on a table.

Figure 2:
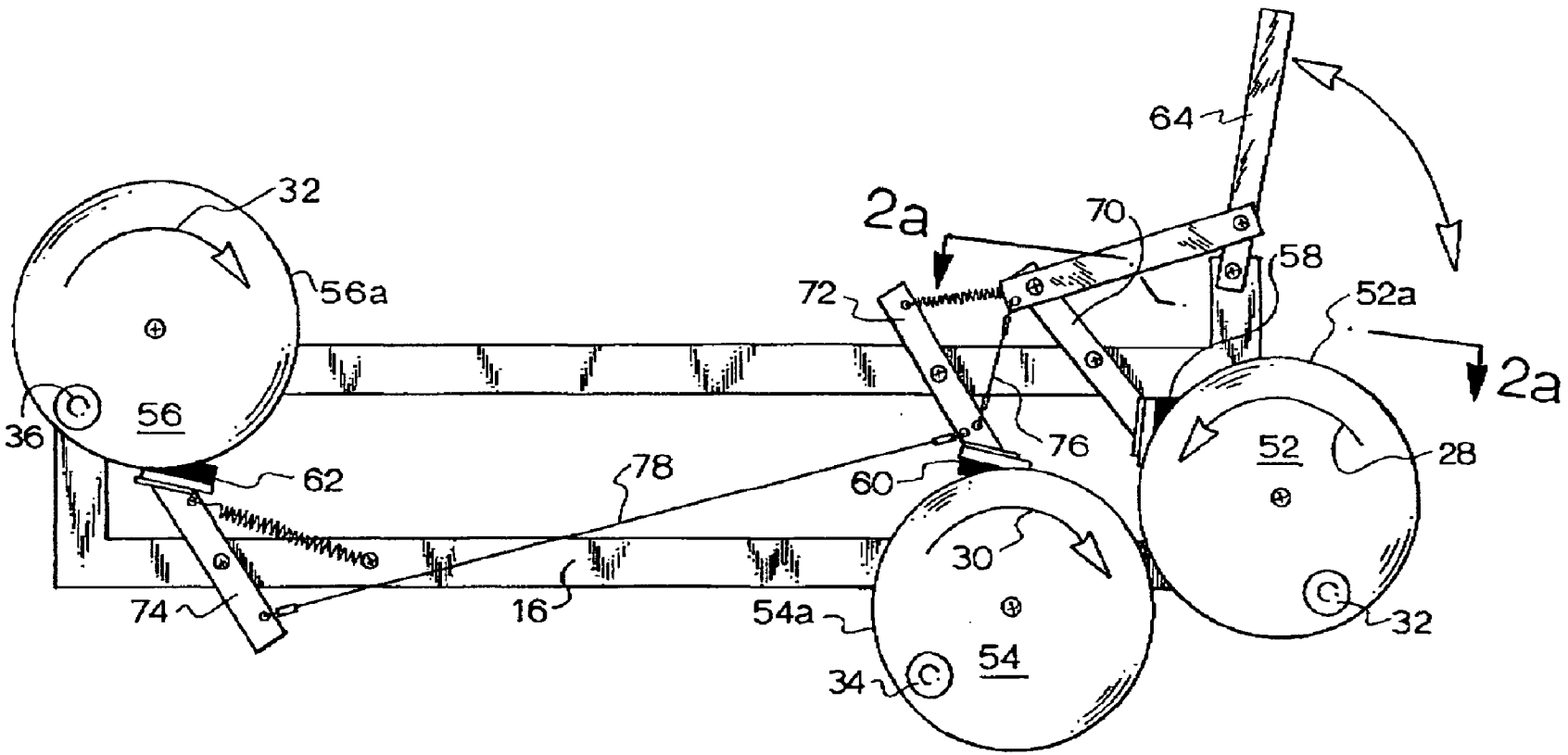
FIGS. 2 and 2A, shows detail of a preferred braking means of the invention in the braked position.

FIG. 2 shows detail of a preferred quick release lever operated braking means of FIG. 1. The lever 64 applies pressure to the brake shoes 58, 60, 62 via which engage the grooves 52*a*, 54*a*, 56*a* of the V pulleys 52, 54, 56 via the articulated system comprising spring loaded pivoting members 70, 72, 74. Cables 76, 78 joining the pivot members transfer the lever action to brake shoes 58, 60, 62 at the ends of pivot members so that disc members preferably V pulleys can be braked simultaneously via the spring loaded 66, 68 pivot members.

Figure 2A:
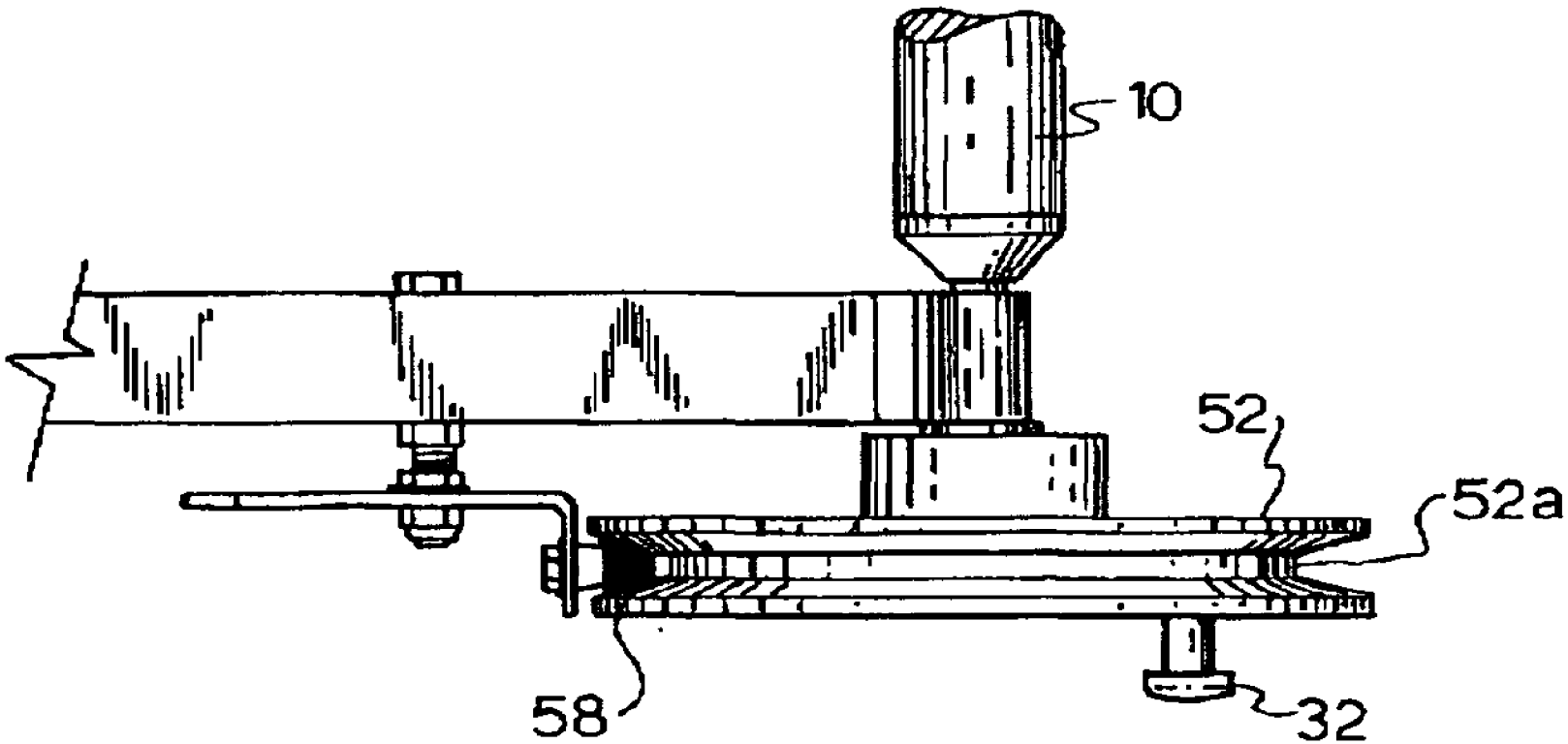

FIG. 2A shows a top view of the V-Pulley 52 with the brake shoe 58 engaging the groove 52*a* of the pulley. The pulley is connected to a roller member 10 over which the material 30 is wound. The pulleys and the lever system is supported on a frame 16 which is preferably of light weight aluminum sections or equivalent construction. In this position, the disc members 52, 54, 56 and hence the roller members can only turn in the direction of the arrows 28, 30, 32. This is to allow the fabric material to be accurately tensioned with respect to the feed roller members 52, 54 and the take up roller member 56.

Figure 3:
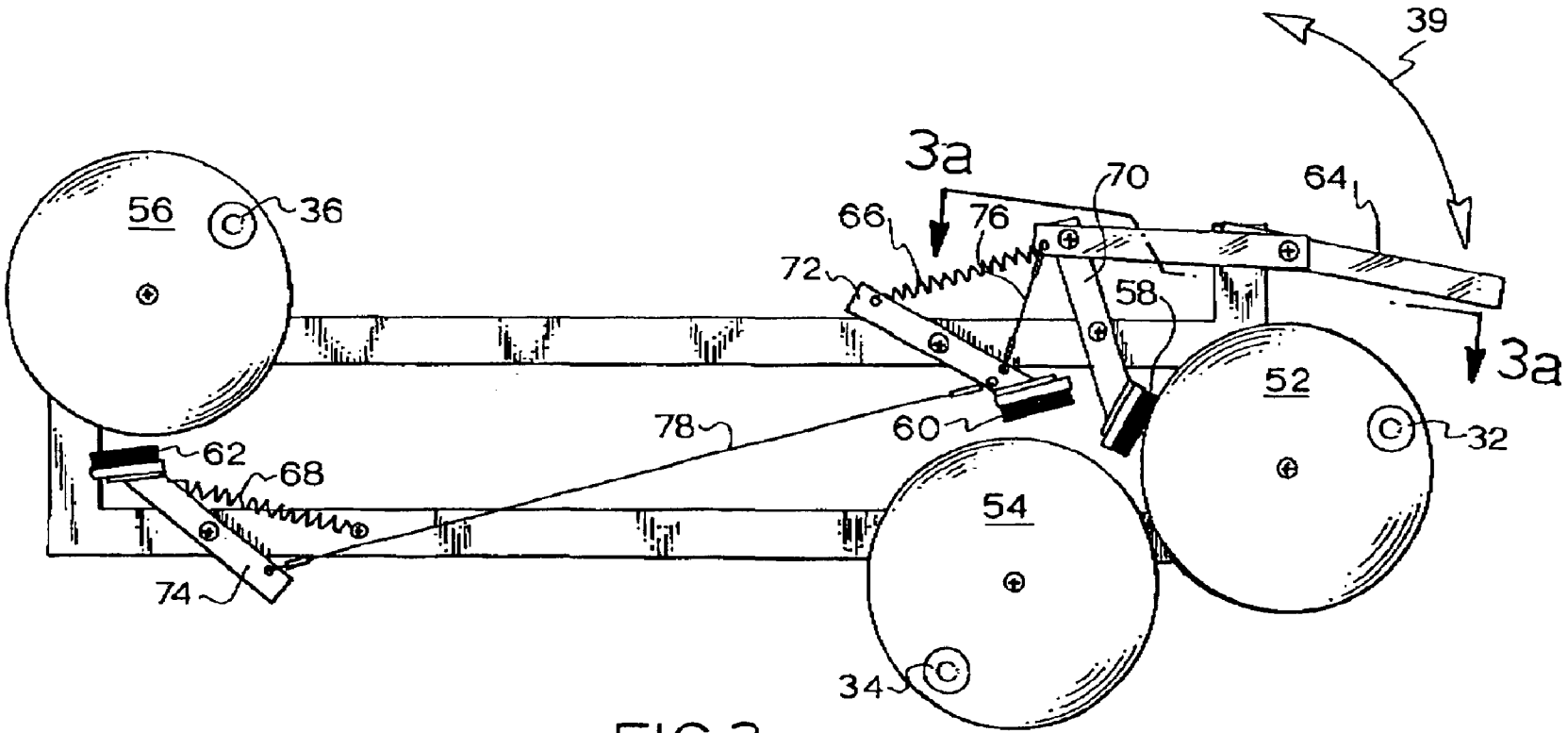
FIGS. 3 and 3A shows detail of the braking means of FIG. 2 in the released position.
Figure 3A:
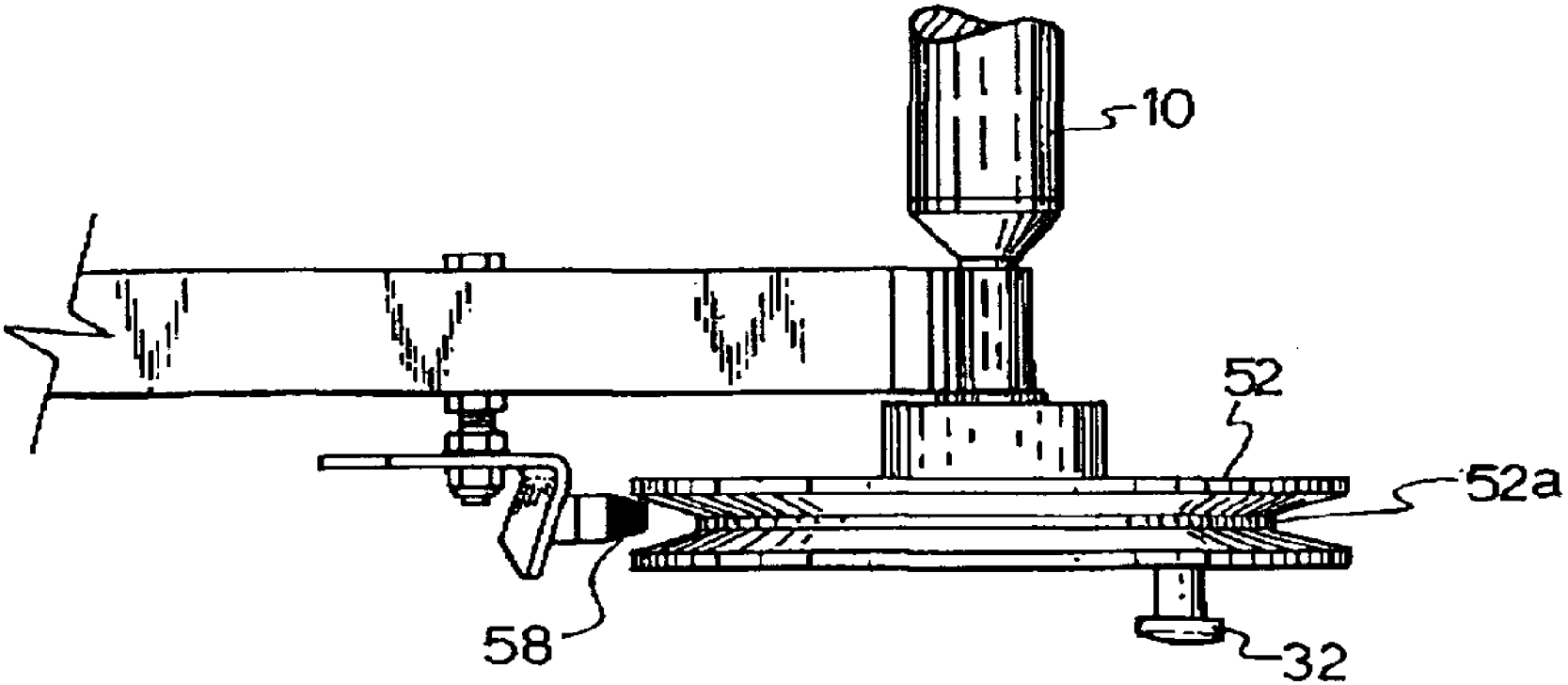

FIGS. 3 and 3A shows detail of the lever operated braking means of FIG. 1 in the released position. The lever 64 is pushed in the direction of arrow 39 which releases the brake shoes 58, 60, 62 from the grooves of the pulleys 52, 54, 56 via the cables 76, 78 connecting the pivoting members 70, 72, 74 and stretching springs 66, 68. In this position, the disc members 52, 54, 56 can turn freely in both directions to enable continuous stitching of indefinite length towards or away from the sewing machine mounted perpendicularly to the roller members.

VARIATIONS

It will of course be realised that while the foregoing has been given by way of illustrative example of this invention, all such and other modifications and variations thereto as would be apparent to persons skilled in the art are deemed to fall within the broad scope and ambit of this invention as is herein set forth.

Throughout the description and claims this specification the word "comprise" and variations of that word such as "comprises" and "comprising", are not intended to exclude other additives, components, integers or steps.

What is claimed is:

1. A quilting machine including:

a frame to support at least one pair of elongated roller members, the roller members are spaced apart and freely rotating and adapted to support quilting fabric material disposed therebetween and wound around the roller members, the rotation of the roller members enabling the material to be rolled towards and away from the sewing arm of a sewing machine, sliding track means adapted to support the sewing machine, the track members slidable in a directional plane parallel to and perpendicular to the roller members, quick release braking means adapted to brake the rotation of the roller members, wherein in use, in co-operation with the sliding track means, and by applying and releasing the braking means, the direction of rotation of the roller members can be controlled and material can be rapidly rolled towards or away from the sewing machine to enable continuous stitching of indefinite length to be sewn in either direction perpendicular to the roller members irrespective of the depth the sewing machine arm as well as in a direction parallel to the roller members without doubling back or braking the stitch line.

2. A quilting machine as claimed in claim 1 wherein the quilting machine is demountable so as to be portable and the components including the roller members, braking means, and the sliding track means are made of a lightweight material such as aluminum or an equivalent lightweight material of suitable strength.

3. A quilting machine as claimed in claim 1 wherein the quick release braking means comprises disc members at the end of each of the roller member, said disc members braked by a spring loaded lever operated pivot action brake which applies braking pressure via brake shoes or pads to each disc member.

4. A quilting machine as claimed in claim 1 wherein the braking means is a hydraulically operated braking system or a cable braking system which applies and releases pressure to the disc members via brake shoes or pads which engage the disc members.

5. A quilting machine as claimed in claim 1 wherein the quick release braking means comprises disc members at the end of each of the roller members that are braked and released simultaneously.

6. A quilting machine as claimed in claim 1 wherein the quick release braking means comprises disc members at the end of each of the roller members that are braked and released individually and non simultaneously.

7. A quilting machine as claimed in claim 1 wherein the quick release braking means comprises disc members at the end of each of the roller members that when braked can still be rotated in at least one direction to enable the fabric material to be accurately tensioned with respect to the roller members.

8. A quilting machine as claimed in claim 1 wherein the disc members of the braking means have winding handles for the quick rotation of the roller members.

9. A quilting machine as claimed in claim 1 wherein the sliding track means includes a platform to support a domestic sewing machine having a nylon or other equivalent runners and/or wheels for smooth operation to enable the sewing machine to be drawn by a user across the roller members and along the length of the roller members.

10. A quilting machine as claimed in claim 1 wherein the sliding track means includes trigger means adapted to operate the sewing machine which is easily assessable to the user.

* * * * *